United States Patent [19]

Goto

[11] 4,089,636

[45] May 16, 1978

[54] BATTERY IGNITABLE CIGARETTE LIGHTER

[75] Inventor: Kenjiro Goto, Urawa, Japan

[73] Assignee: Mansei Kogyo Kabushiki Kaisha, Japan

[21] Appl. No.: 750,709

[22] Filed: Dec. 15, 1976

Related U.S. Application Data

[63] Continuation of Ser. No. 539,529, Jan. 8, 1975, abandoned.

[30] Foreign Application Priority Data

May 20, 1974 Japan ..... 49-57221

[51] Int. Cl.[2] ..... F23Q 2/08

[52] U.S. Cl. ..... 431/132; 431/255

[58] Field of Search ..... 431/131, 132, 255, 144, 431/146, 150, 135, 134, 137

[56] References Cited

U.S. PATENT DOCUMENTS

| | | | |
|---|---|---|---|
| 3,321,671 | 5/1967 | Remy et al. | 431/255 |
| 3,873,262 | 3/1975 | Pogrell | 431/132 |
| 3,883,246 | 5/1975 | Courier de Mere | 431/255 X |

*Primary Examiner*—Edward G. Favors

*Attorney, Agent, or Firm*—Armstrong, Nikaido, Marmelstein & Kubovcik

[57] ABSTRACT

The present invention provides a battery ignitable lighter comprising a casing and a cap which is pivotally mounted on the casing. A fuel tank is arranged within the casing to maintain gas therein, and a nozzle is connected to the fuel tank. A cap controlling means is movable in accordance with the pivotable movement of the cap for controlling the opening and closing movement of the cap and the nozzle. A spark gap is provided along with an ignition circuit means for generating sparks across the spark gap. An insulative housing is arranged within the casing to enclose the ignition circuit means therein. A switch means is electrically connected to the ignition circuit. The switch means is positioned in the path of the cap controlling means such that the switch is moved into its operable state for energizing the ignition circuit by the movement of the cap controlling means in response to the opening of the cap. A cell is connected through the switch means to the ignition circuit. A cell chamber is provided for receiving a cell therein, the chamber being positioned under the insulative housing.

20 Claims, 9 Drawing Figures

BATTERY IGNITABLE CIGARETTE LIGHTER

This is a continuation, of application Ser. No. 539,529 filed Jan. 8, 1975 now abandoned.

BACKGROUND OF THE INVENTION

1. Field of the Invention

The present invention relates to a pocket, battery ignitable lighter and particularly to a switch mechanism in the ignition circuit for safely operating the lighter.

2. Description of the Prior Art

In a known type of a battery ignitable lighter, it is usual to provide a switch button for igniting a gaseous fuel. The switch is located on the exterior of the casing of the lighter and thus, inherently possesses the danger of an unwanted operation thereof.

SUMMARY OF THE INVENTION

It is therefore an object of the present invention to provide a battery ignitable lighter in which a switch is designed to prevent unwanted operation.

It is another object of the invention to provide a battery ignitable lighter in which a switch is arranged inside a lighter cap to prevent problems caused, for example, by dust, dirt or the like from the outside of the lighter.

It is a further object of the present invention to provide a battery ignitable lighter in which, when the lighter cap is opened, a switch is designed to project outside the casing so as to be easily actuated.

In the lighter according to the present invention, an ignition circuit of the lighter is operated by a switch which is arranged in the lighter cap and is designed to be outside the casing when the lighter cap is opened. Thus, the switch can not be actuated in the closed position of the lighter cap. Therefore, this lighter offers safety in the actuation of the lighter due to unwanted operation.

BRIEF DESCRIPTION OF THE DRAWINGS

By way of example only, a preferred embodiment of the invention will now be described with reference to the accompanying drawings, in which.

DETAILED DESCRIPTION OF THE PREFERRED EMBODIMENT

Figure 1:
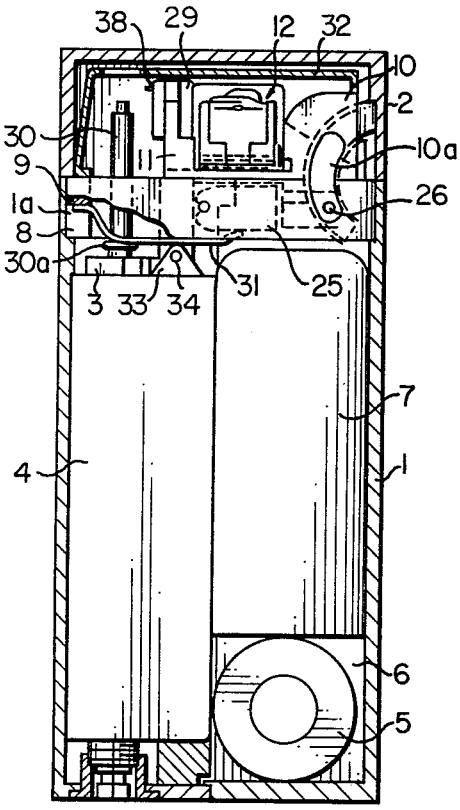
FIG. 1 is an elevational view in section of an embodiment of a battery ignitable lighter according to the present invention.
Figure 2:
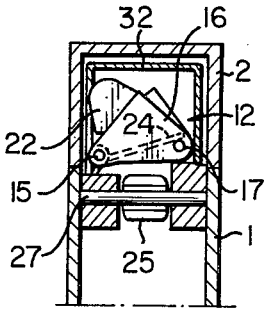
FIG. 2 is an upper side view in section of the lighter of FIG. 1.
Figure 8:
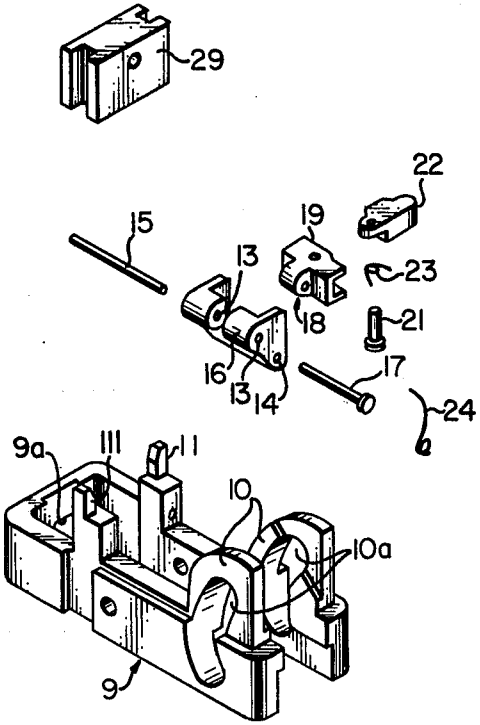
FIG. 8 is an exploded view in perspective of the switch means of the lighter shown in FIG. 1.
Figure 6:
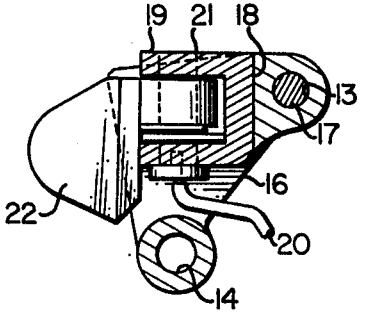
FIG. 6 is a cross-sectional view taken on line A-A of FIG. 5.
Figure 7:
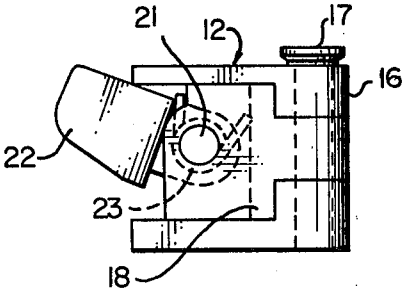
FIG. 7 shows the actuator of FIG. 5 in the actuated position.

Referring to FIG. 1, there is shown an embodiment of a battery ignitable lighter comprising a lighter casing consisting of a casing 1 and a lighter cap 2; and a fuel tank 4 within the casing 1 having a burner valve 3. A wind shield 32 covers a burner nozzle 30 and switch means 12 is arranged above the opening 1*a* of the casing 1 and is fixed on a pillow 33 provided on the fuel tank 4 through a fixing axis 34. A circuit housing 7 is arranged side by side with the fuel tank 4 with an ignition circuit therein and a cell chamber 6 is provided for receiving a cell 5, as for example a mercury cell or silver oxide cell, therein. In an inner recess 8 of the casing 1, a supporting frame 9 is mounted such as shown in FIG. 8. The supporting frame 9 includes right and left side guide portions 10 having guide openings 10*a* for guiding the lighter cap 2 and supporting posts 11 for supporting an electrode support 29.

In FIGS. 2 to 8, a switch 12 for the ignition circuit is arranged between the guide portion 10 and the supporting post 11. The switch comprises a metallic switch cover 16 having first and second through-bores 13 and 14, a switch lever 22 made of metal, and an insulating member 18 which is arranged between the switch cover 16 and the switch lever 22 for providing insulation therebetween and for supporting the switch lever 22 through a lever axis 21. The switch lever 22 is pivotally mounted on the lever axis 21 in a supporting portion 19 of the insulating member 18 and is electrically connected to the ignition circuit through the lever axis 21 and a lead wire 20. A lever spring 23 around lever axis 21 is arranged to urge the switch lever 22. The first through-bore 13 of the switch cover 16 is used to fix the insulating member 18. The second through-bore 14 is used for an axis 15 by which switch cover 16 is rotatably fixed between the guide portion 10 and the supporting post 11 of the supporting frame 9.

A return spring 24 is arranged around the axis 15, one end of which engages fixing pin 17 and the other end of which engages the supporting frame 9 whereby the switch 12 is always urged inside the casing 1.

Figure 3:
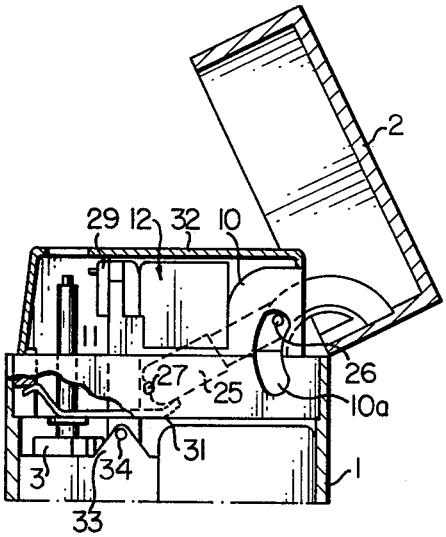
FIG. 3 is an upper elevational view in section of the lighter of FIG. 1 with the lighter cap in an open position.
Figure 4:
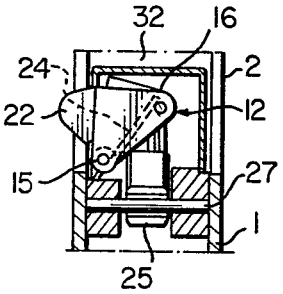
FIG. 4 is an upper side view in section of the lighter of FIG. 3.
Figure 5:
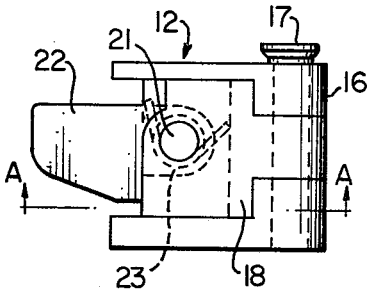
FIG. 5 shows an actuator of a switch of the lighter shown in FIG. 1.

As shown in FIGS. 1 and 3, a telescopic cyclinder 25 is positioned under the switch means 12 to promote the movement of the lighter cap 2. The telescopic cylinder 25 engages a cap axis 26 of the lighter cap 2 and a supporting axis 27 is fixed in the side walls of the supporting frame 9 at the left and right ends thereof respectively and functions as a cap controlling means. A valve manipulator 31 engages a U-shaped cutout 9*a* of the supporting frame 9 and the telescopic cylinder 25 at the right and left ends thereof respectively and also engages a shoulder portion 30*a* of the burner valve 3. The telescopic cylinder 25 depresses the burner valve 3 through the valve manipulator 31 against the force of a valve spring arranged within the burner valve 3 so as to close the valve in the closed position of the lighter cap 2. The telescopic cylinder 25 also pushes the switch means 12 against the force of the return spring 24 so that the switch lever 22 moves outside the casing 1 in the open position of the lighter cap.

Figure 9:
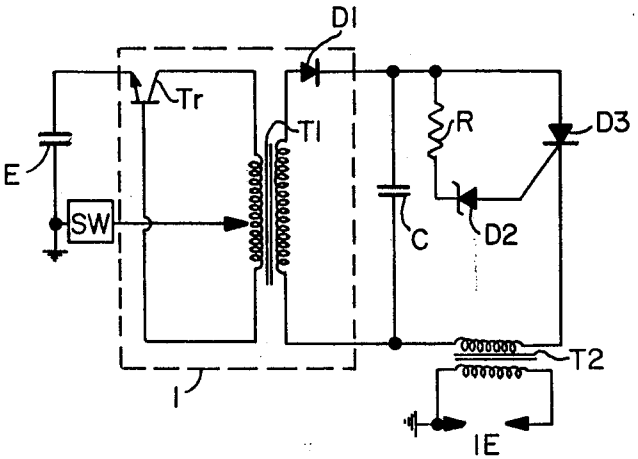
FIG. 9 is a circuit diagram used in the lighter of FIG. 1.

FIG. 9 shows and ignition circuit of the present invention which comprises a cell E whose positive pole is grounded, and switch SW is connected to the positive pole of the cell. A DC—DC converter I is provided which includes a transistor Tr, a transformer T1, and a rectifier D1. A triggering circuit is connected to the DC—DC converter, the triggering circuit comprising a zener diode D2 and resistor R. A discharge circuit comprising a capacitor C, a step-up transformer T2, and SCR D3, and ignition electrodes IE is connected to the triggering circuit.

The DC—DC converter I comprises a conventional blocking oscillator in which the transistor Tr functions in a known manner as a high-speed switch or vibrator. The current through the emitter-collector circuit is dependent on the current through the emitter-base circuit. Thus, if the bias voltage on the base drops to zero or becomes negative, current through the emitter-collector circuit is cut off. In other words, emitter-collector current is controlled by the bias voltage on the base. In this circuit, the emitter and collector are connected to the primary of the transformer T1 through the cell E, while the base is connected to the cell E through a resistor R1 and a feedback winding L. When the switch SW is closed, the fixed bias voltage on the base of the transistor permits a surge of current through the primary and as a result, a voltage is induced in the feedback winding L. This induced voltage reacts with the fixed bias voltage to change the voltage on the base of the transistor Tr. As a consequence, current in the emitter-collector circuit is affected and this, in turn, causes a change in the induced feedback voltage. As a result of these fluctuations, a pulsating DC current is set up in the primary which induces a high voltage in the secondary winding. In this way, the DC—DC converter I changes the cell voltage from a lever of a few volts to a level considerably greater. The half-wave voltage obtained through the DC—DC converter changes the capacitor C to a predetermined level and the zener diode breaks down to trigger the SCR D2 into a state of conduction to allow the capacitor C to discharge through the primary winding of the step-up transformer T2. The resultant current flow causes a high voltage pulse output from the secondary winding of the step-up transformer T2 which causes the ignition electrodes IE connected across it to spark over to ignite the fuel of the lighter.

In operation, when the lighter cap 2 is opened through the extending force of the telescopic cylinder 25, the burner valve 3 is opened to issue the fuel by the force of a spring (not shown) arranged in the valve at the predetermined point of the upward movement of the telescopic cylinder 25 where it ceases to depress nozzle 30 downward through the valve manipulator 31. At the same time, the cylinder 25 pushes the rear portion of the cover member 16 so that the switch lever 22 may appear outside the casing 1. Then the switch lever 22 is rotated horizontally at a small angle about its lever axis 21 to bring it into contact with the portion of the switch cover 16 thereby to close the ignition circuit. As long as the switch is closed, the spark discharge sequentially occurs at the ignition electrodes IE which are formed by the burner nozzle and the discharge electrode to form the spark gap in the above-mentioned operation.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are therefore to be embraced therein.

I claim:

1. A battery ignitable cigarette lighter comprising:
a casing;
a cap pivotally mounted on said casing;
a fuel tank arranged within said casing for storing fuel gas therein;
a burner nozzle connected to said fuel tank;
a spark gap;
ignition circuit means for generating sparks across said gap;
an insulative housing enclosing said ignition circuit means therein;
switch means arranged to be locked under the control of the pivotal movement of said cap and electrically connected to said ignition circuit means;
support means coupled to said cap and pivotally moveable in accordance with the pivotal movement of said cap for supporting the pivotal movement of said cap, wherein said switch means is positioned such that when said support means is pivotally displaced upon the opening of said cap said switch means is brought into an operable state where said switch means can be actuated to energize said ignition circuit means;
a cell connected through said switch means to said ignition circuit means; and
a cell chamber for receiving said cell therein.

2. A battery ignitable cigarette lighter as set forth in claim 1, wherein said support means is coupled to said cap and is pivotally moveable in accordance with the pivotal movement of said cap for facilitating the opening and closing of said cap.

3. A battery ignitable cigarette lighter as set forth in claim 2 comprising, control means for controlling the opening and closing of said burner nozzle, wherein said support means tranfers the pivotal movement of said cap to said control means in order to cause the opening and closing of said burner nozzle.

4. A battery ignitable cigarette lighter as set forth in claim 3, wherein said switch means is positioned within said casing, and wherein said switch means is positioned such that when said cap is moved into its open position said switch means is brought into said operable state outside of said casing where said switch means can be actuated for energizing said ignition circuit means.

5. A battery ignitable cigarette lighter as set forth in claim 4, wherein said switch means is manually operable when positioned in said operable state.

6. A battery ignitable cigarette lighter as set forth in claim 5, wherein said support means moves said switch means into its operable state outside said casing.

7. A battery ignitable cigarette lighter as set forth in claim 6, wherein said switch means is positioned in the path of movement of said support means, and wherein said cap is opened said support means engages said switch means and moves said switch means into its operable state.

8. A battery ignitable lighter as set forth in claim 2 wherein said support means includes a spring-loaded cylinder which is movable in accordance with the pivotal movement of said cap to facilitate the opening and closing movement of said cap, and wherein the opening movement of said cap displaces said spring-loaded cylinder to bring said switch means into said operable state.

9. A battery ignitable cigarette lighter as set forth in claim 8 wherein said switch means is positioned in the path of movement of said spring loaded cylinder wherein when said cap is opened said spring loaded cylinder contacts said switch means and moves said switch means into its operable state.

10. A battery ignitable cigarette lighter as set forth in claim 9 wherein said switch means is movable to take two extreme positions, an outer position in which said switch means projects out of the contour of said casing and an inner position in which said switch means lies within the contour of said casing, and wherein said spring loaded cylinder controls the movement of said switch means between said extreme positions.

11. A battery ignitable cigarette lighter as set forth in claim 10 including a support frame fixedly secured on said fuel tank and adapted to pivotally support said switch means thereon, wherein said spring loaded cylinder holds said switch means in one of said two extreme positions.

12. A battery ignitable cigarette lighter as set forth in claim 11, wherein said switch means includes a switch cover and a switch lever, said switch cover being supported on said support frame to pivot relative to said support frame, and wherein said spring loaded cylinder is arranged to contact said switch cover such that said spring loaded cylinder urges said switch means outside said casing whereby said switch means is accessible upon the opening of said cap.

13. A battery ignitable cigarette lighter as set forth in claim 12 wherein said switch lever is pivotally supported by said switch cover, and wherein said switch lever protrudes out of said casing due to the contact between said switch cover and said spring loaded cylinder when said cap is opened.

14. A battery ignitable cigarette lighter as set forth in claim 13 wherein said switch cover is pivotally mounted on said support frame by an axle having a spring therearound with one end of said spring acting on said switch cover and the other end of said spring abutting against said supporting frame whereby said switch cover is normally urged inside of said casing under the action of said spring.

15. A battery ignitable cigarette lighter as set forth in claim 14 wherein said switch cover and said switch lever are made of electrically conductive material and said switch means includes an insulating member interposed between said switch cover and said switch lever, and wherein said switch cover and said switch lever form a switching contact point in said ignition circuit means.

16. A battery ignitable cigarette lighter as set forth in claim 15 wherein said insulating member is fixedly secured on said switch cover by an axle member, and wherein said insulating member pivotally supports said switch lever with respect to said switch cover.

17. A battery ignitable cigarette lighter as set forth in claim 16 wherein said switch lever is pivotally positioned on said insulating member by a lever axle and is adapted to come into contact with said switch cover so as to close said ignition circuit means.

18. A battery ignitable cigarette lighter as set forth in claim 17 wherein said lever axle is made of electrically conductive material through which said switch lever is electrically connected to said ignition circuit means.

19. A battery ignitable cigarette lighter as set forth in claim 18 wherein a spring is provided around said lever axle for normally preventing said switch lever from pivoting in the direction to said switch cover.

20. A battery ignitable cigarette lighter as set forth in claim 19 wherein said switch lever is pivoted in the direction perpendicular to the direction in which said switch cover pivots relative to said support frame.

* * * * *